United States Patent [19]

Michel et al.

[11] 4,090,699

[45] May 23, 1978

[54] APPARATUS AND METHOD OF CIRCULATING A GAS THROUGH COILS OF VERY LONG TUBING DURING A HEAT TREATMENT

[75] Inventors: Raymond Michel, Paris; Donald Whitwham, Marly-le-Roi, both of France

[73] Assignee: Trefimetaux, Paris, France

[21] Appl. No.: 782,329

[22] Filed: Mar. 29, 1977

[30] Foreign Application Priority Data

Apr. 20, 1976 France ..... 76 12347

[51] Int. Cl.[2] ..... C21D 9/08

[52] U.S. Cl. ..... 266/252; 148/13; 266/274

[58] Field of Search ..... 148/13, 13.1, 13.2, 148/20.3; 266/251, 252, 254, 255, 257, 258, 274

[56] References Cited

U.S. PATENT DOCUMENTS 1,960,808 5/1934 Cope ..... 266/258

*Primary Examiner*—Gerald A. Dost

*Attorney, Agent, or Firm*—Dennison, Dennison, Meserole & Pollack

[57] ABSTRACT

Apparatus and method of circulating a gas through coils of very long tubing during a heat treatment, wherein the coils of tubing are placed on hollow frames through which the clearing gas passes. The frames are fitted with nozzles to which at least one end of each coil can be connected. The invention can be applied to continuous annealing of coils of small-diameter copper tubing with a view to removing the last traces of drawing lubricant.

6 Claims, 12 Drawing Figures

APPARATUS AND METHOD OF CIRCULATING A GAS THROUGH COILS OF VERY LONG TUBING DURING A HEAT TREATMENT

This invention, concerns a method of circulating a gas through coils of very long tubing, particularly metal tubing, during a heat treatment which is carried out continuously in continuous furnaces.

In a process of continuous annealing in a continuous furnace, for example, it is relatively easy to maintain a controlled atmosphere, e.g., a neutral or reducing atmosphere within the furnace, so that solid articles undergoing annealing do not deteriorate at the temperature obtaining in the furnace, which is generally some hundreds of degrees Celsius.

If on the other hand the articles to be annealed are tubes of very small diameter, ranging from a few millimeters to a few centimeters in internal diameter, wound into coils and with a total length of from 10 or so to several hundred meters strict control of the atmosphere inside the tubing becomes impossible. Simply to blow air through cold before placing the coils in the furnace generally has a very limited, if not illusory effect in the case of tubes of small diameter.

Considering the length of continuous annealing furnaces, often several tens of meters, and the temperature obtaining therein, there is no question of all the coils being connected to flexible gas-supplying tubes which would follow them in their passage through the furnace.

The problem is particularly acute when the articles being annealed are coils of copper tubing for watersupply circuits in dwellings or industrial installations. The lubricant used for drawing the tubing, which is made of copper or copper alloys, to its final diameter adheres fairly strongly to the tubing and is therefore extremely difficult to remove, especially from the inside. When annealing takes place, generally at 400° to 550°/600° C, the lubricant undergoes partial pyrolysis and the carbon-containing residues which are left adhering to the inner walls of the tubing give rise to the well known defect of "pitting" in the presence of certain types of water. Pitting consists of the formation of small holes and thus of leakage in the installations.

Applicants' French patent application No. 2,308,436 entitled: "Treatment applied to tubes of copper and copper alloys to remove carbon-containing substances left on the surface" proposes a method which comprises circulating nitrogen, or any other inert or slightly reducing gas, through coils of tubing throughout the annealing treatment (including the rise in temperature, constant temperature and cooling stage). However, this method is difficult to carry out when continuously annealing coils which are passing through a continuous furnace. In the same patent application applicants envisaged connecting each coil to a cartridge of pressurized carbon dioxide by way of a lid which was designed to yield spontaneously under the pressure of the carbon dioxide when the temperature of the tubing to be treated reached 500° C. A strong jet of gas then passes through the tubing, sweeps along the lubricant vapors and ejects them from the tubing.

This arrangement, which is relatively expensive and difficult to apply, is unsuitable for large scale industrial use.

To resolve this problem Applicants have had the idea that the coils of tubing to be annealed, instead of being placed directly on the conventional roller-type driving system, should be placed on metal frames made up of hollow tubes and fitted with nozzles, to which the ends of the coils are connected and through which the clearing gas enters. The frames may form a continuous train or be connected to one another as they progress, by means of an impervious coupling fitted with valves. The gas supply is provided on one of the frames located outside the furance and is displaced as the frames progress so that it always remains outside the furnace. After passing right through the coils the gas can escape freely into the furnace through the other end of the coils, which are left open, or may be returned through a second nozzle into the frame, which would then have two separate circuits, one for supplying gas and one for discharging it. This second arrangement is preferable if the gas used is toxic (carbon monoxide) or entails a danger of explosion (hydrogen).

When the gas is allowed to escape freely into the furnace it helps to maintain a neutral or reducing atmosphere, which may also be desirable, e.g., for preserving the shiny appearance of the annealed copper tubing.

The means for applying the invention will be understood better from the accompanying drawings, in which.

Figure 1:
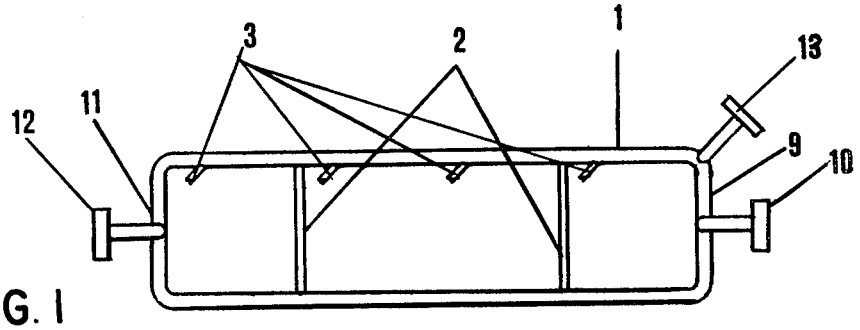
FIG. 1 is a plan view of a frame designed for connecting four coils.
Figure 2:
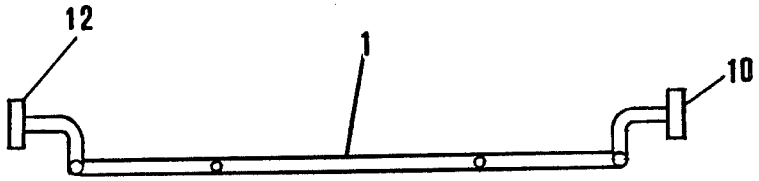
FIG. 2 shows the same frame in elevation.
Figure 3:
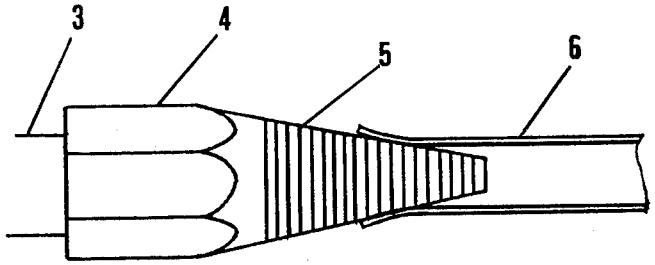
FIG. 3 is a plan view of a type of scored conical nipple for connecting the ends of the coils of tubing.
Figure 4:
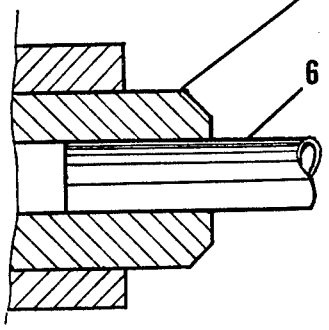
FIG. 4 is a section illustrating a method of connecting the ends of the coils by tongs with a quick gripping action.
Figure 5:
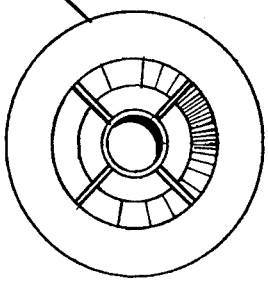
FIG. 5 is an end view of arrangement of FIG. 4.

Referring now to FIG. 1, this shows a simple frame comprising uprights 1 made of tubing with an internal diameter of 30 mm and an external diameter of 40.8 mm. The tubing is made of an alloy which retains its chemical properties and is not oxidized at the temperature chosen for annealing, e.g., a ferritic steel containing 17% of chromium, which is suitable up to about 600° C, or an austenitic steel containing 18% of nickel and 8% of chromium which is highly suitable up to at least 800° C. The frame is braced by two cross tubes 2 with a diameter of 28 × 30 mm made of the same grade of steel. One of the long sides of the frame is provided with nipples 3 to receive nozzles 4 on to which the end of each coil is force fitted. Transverse scores 5 on the nozzles (FIG. 3) ensure that the tube 6 is fixed with the appropriate imperviousness. Any other fixing means may be used, preferably one which is quick to assemble, e.g., gripping means using tongs 7 as shown in section in FIG. 4 and in plan in FIG. 5.

The "front" short side 9 of the frame (in the direction of advance within the annealing furnace) has a means 10 for fixing it to the preceding frame, while the "rear" short side 11 carries a means 12 for fixing it to the following frame and an inlet aperture 13 for the clearing gas. These fixing means will be described later herein.

Since the frames are in continuous motion it is desirable for the fixing means to be of the "quick action" type. It is also preferable for the fixing means and the inlet aperture for the clearing gas to have valves to prevent any air from entering when the various components are connected and disconnected.

Figure 6:
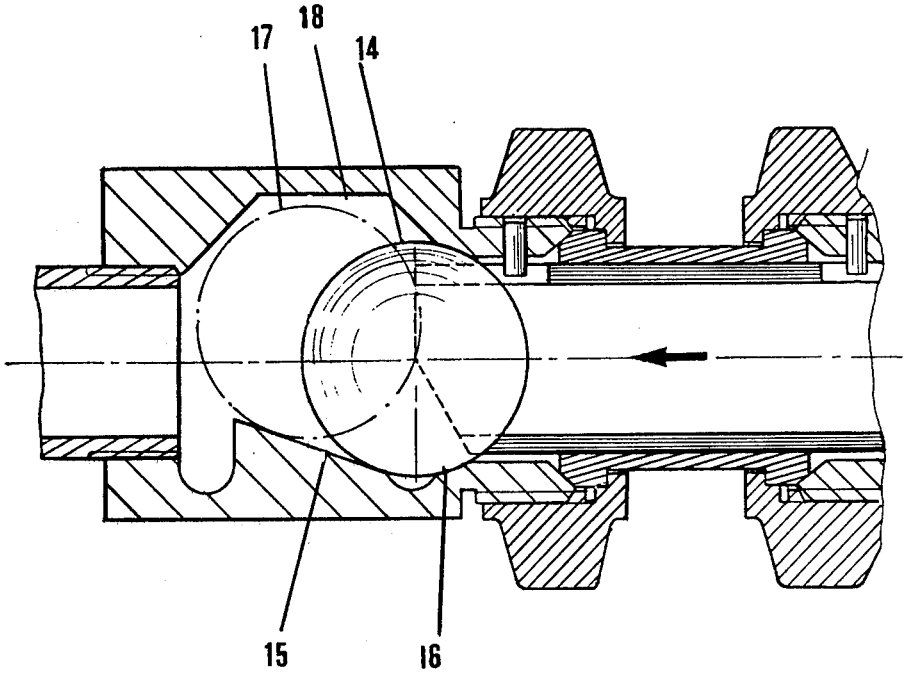
FIG. 6 is a section showing a connection between frames with a ball valve located at the rear of each frame to seal it.

FIG. 6 shows a preferred embodiment of the coupling means 10 and 12 between two frames and the valve, which comprises a stainless steel ball 14 arranged on a slope 15 and bearing by its own weight on a tapered bearing surface 16. The gas, which moves in the direction of the arrow, forces the ball back into the dotted line position 17 and passes through the annular space 18.

Figure 7:
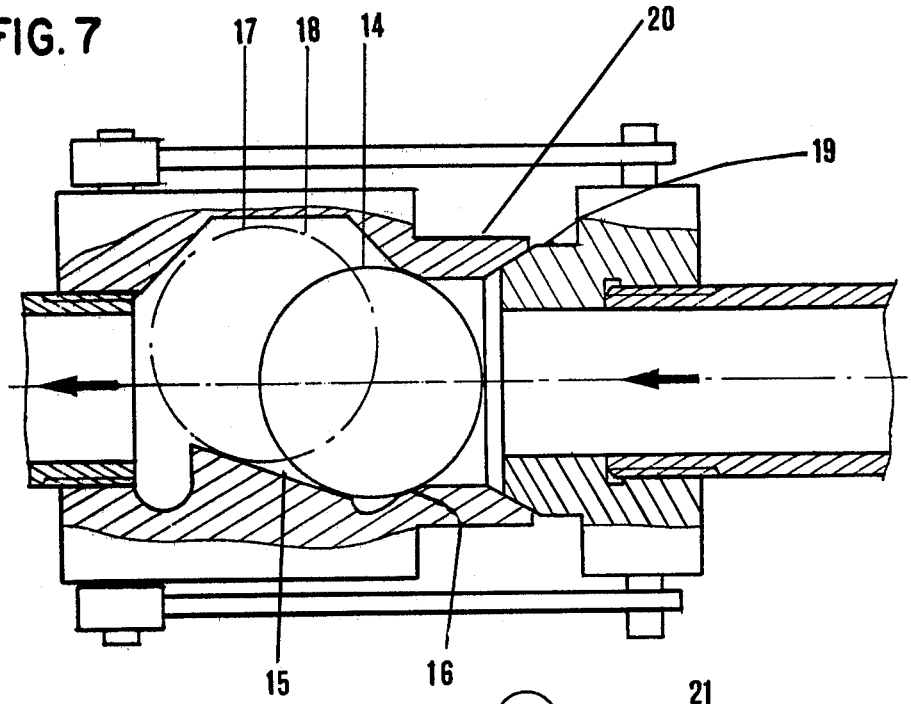
FIG. 7 is a section through an arrangement for interconnecting the frames rapidly by means of a tapered joint and a fixing clip.
Figure 8:
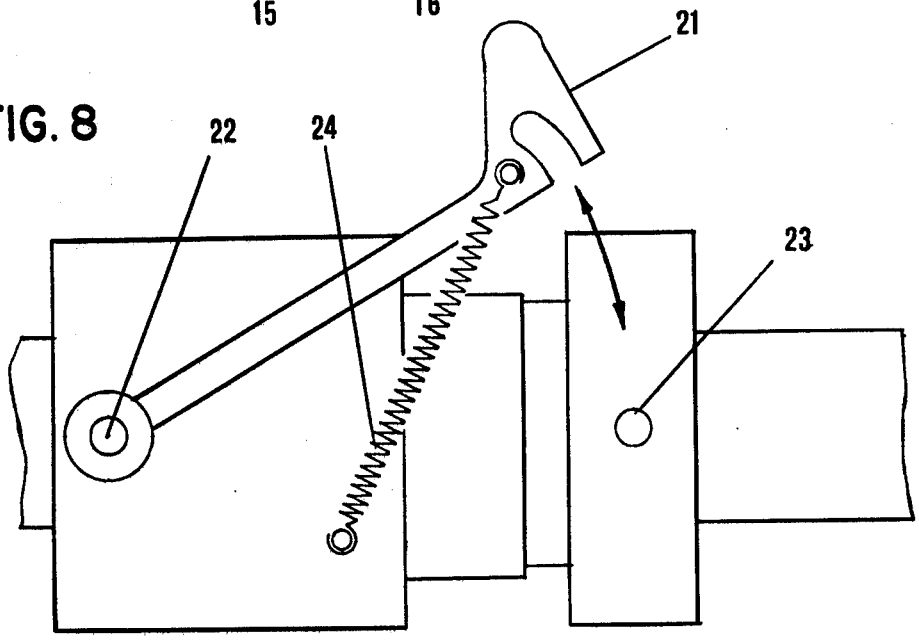
FIG. 8 is a plan view of the arrangement of FIG. 7 as seen from above.

FIGS. 7 and 8 show a different type of coupling comprising a male joint 19 in front of a frame and a female component 20 at the rear portion, interacting respectively with the female and male components of the preceding and following frames. The gripping action is provided by a locking clip 21 which pivots about an axis 22 and is locked over catch 23. The spring 24 can obviously only function if it is made of a metal or alloy which preserves its elasticity at the temperature obtaining within the annealing furnace. The spring is in any case optional.

This type of coupling, which also includes a valve, e.g., a ball valve as described above, lends itself fairly readily to automatic opening when the frame emerges from the furnace. This is done with a stationary arm (not shown) which is mounted on the framework of the furnace and which engages and raises the locking clip 21 as it passes.

Figure 9:
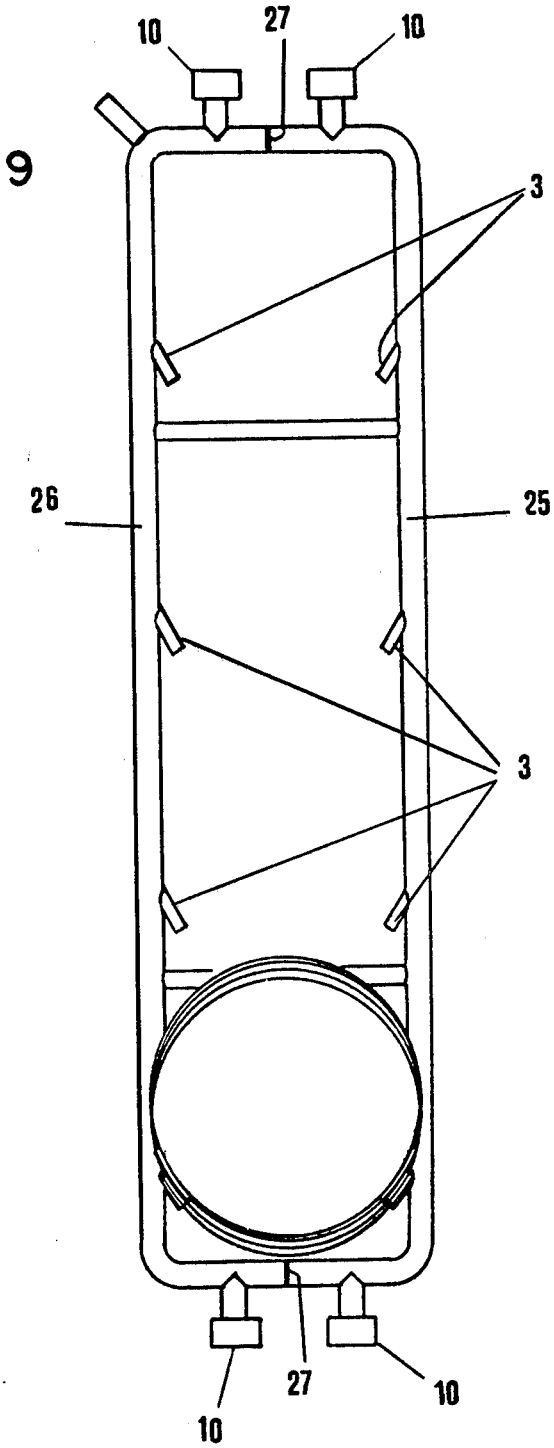
FIG. 9 shows a frame with two gas circuits (inlet and outlet); for the sake of clarity only one coil is shown although several can be usefully connected.

FIG. 9 shows a frame with two circuits of clearing gas, a supply circuit 25 and a discharge circuit 26. In this case the frame is divided into two sections by internal partitions 27. Each lateral upright comprises nipples 3 and means 4 of the type shown in FIG. 3 for fitting on the ends of the coils of tubing, while each short side, upstream and downstream, has two coupling means 10 corresponding to the two gas circuits. The coupling means, which are indicated very diagrammaticallly, are of the same type as those described above. This arrangement is preferable when the clearing gas entails a danger of toxicity (carbon monoxide) or explosion (hydrogen).

Figure 10:
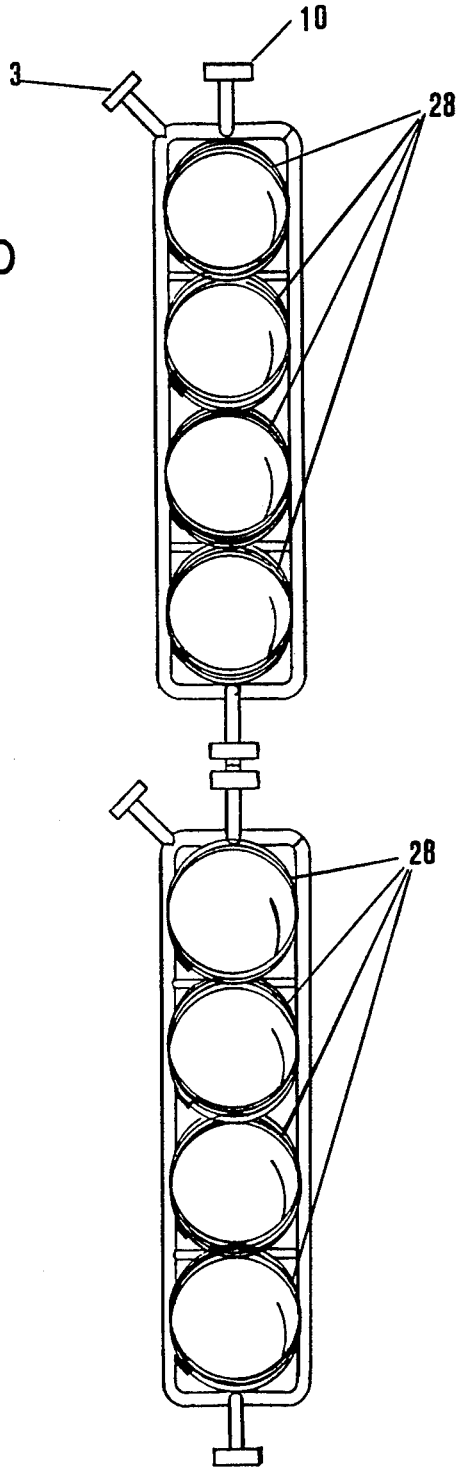
FIG. 10 shows two coupled frames each supporting four coils; after passing through the coils the gas escapes freely through the other end.

By way of example FIG. 10 shows two coupled frames each supporting four coils of tubing 28. One end of each coil is fixed to one of the nozzles and the other ends are left free.

Figure 11:
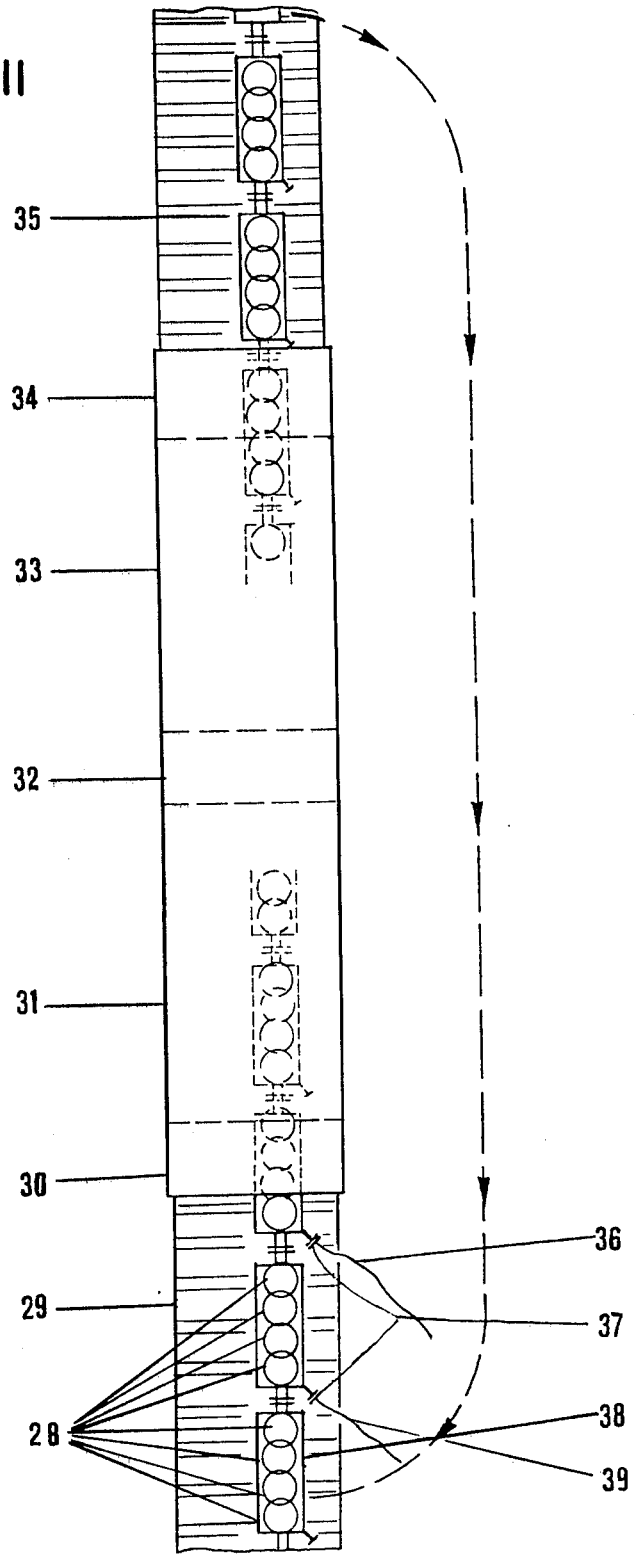
FIG. 11 is a diagram showing the whole of a continuous annealing furnace using the system of frames according to the invention.

FIG. 11 shows the general arrangement of an installation according to the invention, for continuously annealing coiled copper tubing. It comprises a furnace-charging cable 29 with rollers, an inlet lock chamber 30, a heating zone 31, an intermediate water jacket zone 32, a cooling zone 33, a discharge lock chamber 34 and a discharge table 35 with rollers. The frames, previously fitted with the coils 28 which have to be annealed, are coupled in a continuous train on the assembly table. The clearing gas is supplied to the most upstream frame 38 by means of a flexible pipe 36 and a quick-action coupling 37. As the train of frames advances a second flexible gas-supply pipe 39 is connected to the most upstream frame, and the first pipe 36 is disconnected before the frame enters the lock chamber 30. The continuity of the gas supply is thus ensured without any danger of external air entering, by virtue of the valves provided on the connecting means.

Gas may equally be supplied through the frames leaving the furnace, needless to say with the supply tubes being displaced as the frames emerge. The frames may equally be supplied with gas both on entering and leaving the furance, without this having any marked effect on the cirulation of gas within the coils.

The uncoupled frames on discharge table 35 are relieved of the coils of tubing, which are cooled sufficiently to be handled, and are returned to the furnace-charging table 29.

Other arrangements may equally well be used for carrying out the invention.

Figure 12:
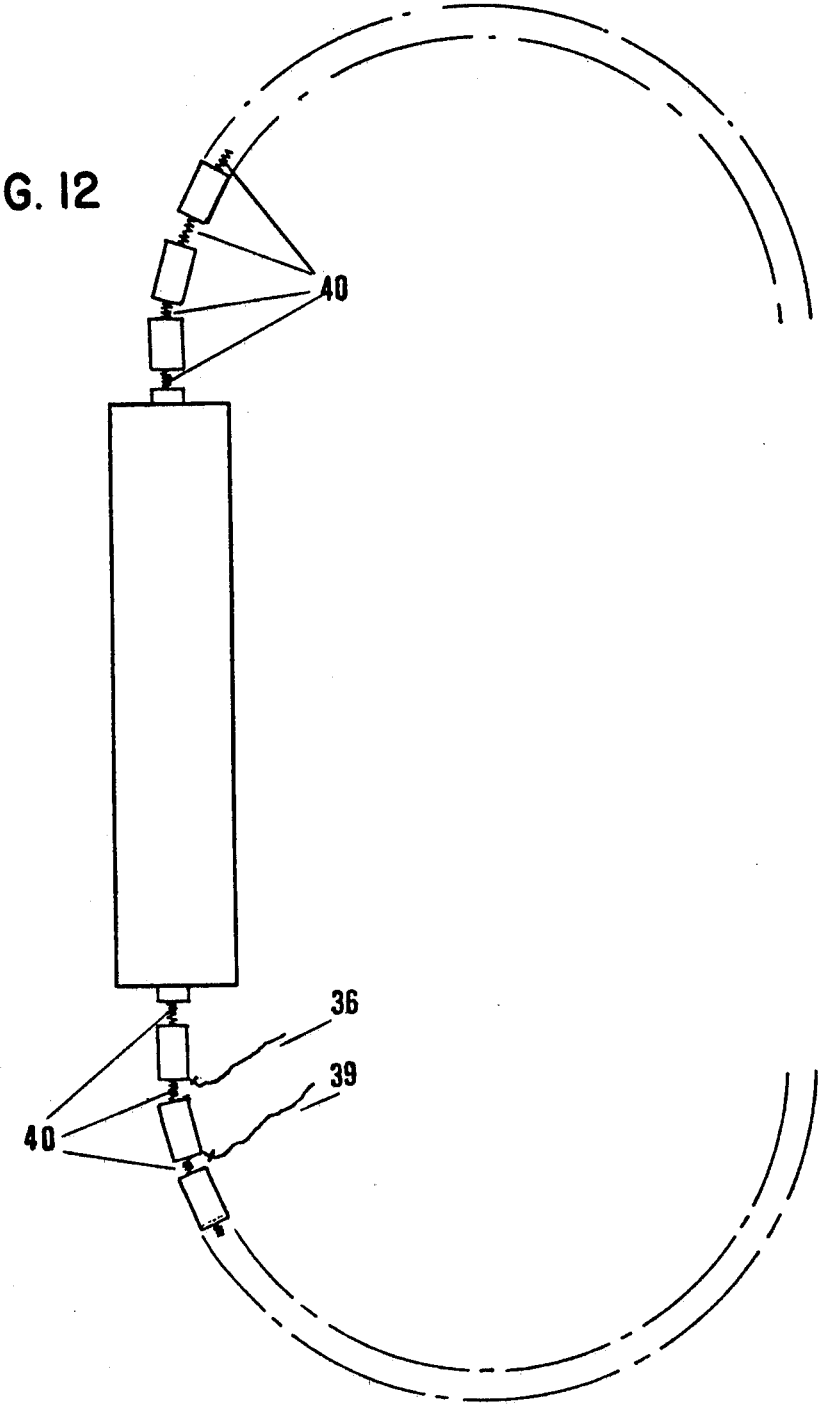
FIG. 12 is a diagram showing the whole of an annealing furnace in which the frames are permanently connected by flexible metal diaphragms to form a continuous train.

FIG. 12 shows the general arrangement of a continuous annealing installation in which the frames are permanently linked by flexible metal connectors 40 known as "accordion diaphragms." When the frames have passed through the annealing furnace this enables them to return to its mouth, following the path indicated by the arrows. In this arrangement, as in the previous one, the gas intake must be gradually displaced as the train of frames enters the furnace.

EXAMPLES

Annealing treatment is applied to coils of copper tubing 10/12 mm in diameter and 50 meters long, grouped in fours on frames 1.9 meters long and 0.5 meters wide. The total length of the furnace is 35 meters, not including the inlet and discharge tables but including 3 meters for the inlet lock chamber, 13 meters for the heating zone which reaches 500°/600° C, 3 meters for the water jacket, 12 meters for the cooling zone and 4 meters for the discharge lock chamber. The speed of advance within the furnace is fixed at 1.10 meters per minute. A gas generator, supplying a mixture:

$CO_2 = 12\%$; $CO = 3\%$; $N_2 = 85\%$, all by volume, feeds the coils by way of the frames, at an approximate pressure of 0.2 to 0.5 bar, and also feeds the furnace directly. By virtue of the carbon monoxide it maintains a slightly reducing atmosphere in the furnace, which preserves the shiny appearance of the copper tubing. The gas which has passed through the coils of tubing escapes freely into the atmosphere in the furnace. However, the flow rate of this gas is regulated so that the leakage from the ends of the coils becomes almost zero when the coils emerge from the furnace into the open air. A carbon monoxide detector, placed in areas where workers are operating, avoids any danger of intoxication. About $\frac{1}{3}$ of the clearing gas passes directly into the furnace and the other $\frac{2}{3}$ pass through the coiled tubing.

A first series of tests is carried out without circulating any gas within the coils, apart from a cold purge to eliminate air before the tubes enter the furnace. All the clearing gas is let into the furnace.

In a second series of tests the gas generator is then connected to the frames so as to maintain circulation within the coils of tubing throughout the annealing treatment. Three coils are taken as samples at each test and specimens of tubing are taken from them at the end of the gas inlet A, a quarter of the way along the length B, at the center C, three-quarters of the way along the length D and at the end of the gas outlet E.

For each specimen of tubing the amount of residual carbon on the inner surface is ascertained (after very carefully cleaning the outer surface), with the following results, expressed in milligrams of carbon per square decimeter of area of copper tubing.

Table 1
residual carbon content after annealing, in mg/dm²

| Number of Coil | Gas Circulation | Sampling Point A | B | C | D | E | Average |
|---|---|---|---|---|---|---|---|
| 4 | No | 0.15 | 0.21 | 0.15 | 0.19 | 0.21 | 0.18 |
| 6 | No | 0.11 | 0.09 | 0.13 | 0.16 | 0.11 | 0.12 |
| 9 | No | 0.13 | 0.13 | 0.16 | 0.16 | 0.15 | 0.15 |
| 11 according to the | Yes | 0.09 | 0.09 | 0.07 | 0.07 | 0.06 | 0.08 |
| 13 invention | Yes | 0.06 | 0.06 | 0.09 | 0.10 | 0.10 | 0.09 |
| 15 | Yes | 0.06 | 0.06 | 0.07 | 0.08 | 0.07 | 0.07 |

Experience shows that corrosion by pitting may take place even where the carbon content on the inner wall of the copper tubing is as low as 0.4 to 0.5 mg per $dm^2$. Below 0.10 $mg/dm^2$ the danger of corrosion is almost zero. The application enables a carbon content below 0.10 $mg/dm^2$ to be obtained right along the coils, and it can therefore be considered as completely eliminating the danger.

The arrangement for circulating gas within coils of tubing during an annealing process carried out continuously in a continuous furnace is particularly well adapted to the problem of removing the residual drawing lubricant from copper tubing, in the form of coils which may be some hundreds of meters long. However, it is equally suitable for any other type of treatment in which a controlled atmosphere has to be maintained or coils of tubing passing through a continuous furnace have to be cleared; for example, for deoxidizing the interval walls by circulating a reducing gas (CO or $H_2$), or for depositing a constituent obtained from thermal cracking of a gas or from a reaction between two gases or vapors.

What is claimed as new and intended to be secured by letters patent is:

1. Apparatus for circulating a clearing gas through long coils of tubing during a continuous heat treatment in a continuous furnace, comprising a plurality of hollow generally rectangular metal frames, a plurality of nozzles on each frame adapted to receive one end of each of the coil being treated, means for admitting and discharging the clearing gas from said frames, and means for interconnecting the frames longitudinally to each other.

2. Apparatus as set forth in claim 1, wherein the means for interconnecting the frames and the means for admitting the clearing gas each are fitted with sealing valves.

3. Apparatus as defined in claim 2, wherein the valves are of the self-acting ball type.

4. Apparatus as defined in claim 1, wherein each frame is provided with interal partition means to divide the frame longitudinally into two separate gas flow circuits and wherein one end of each coil to be treated is connected at one end to one of said nozzles corresponding to one gas circuit and the other end of each coil being connected to another of said nozzles corresponding to the other gas circuit, one of the circuits providing for the admission of said clearing gas and the other of said circuits for its discharge.

5. Apparatus as defined in claim 1, and further including pivoted latch means at one end of each frame and catch means on the opposite end of each frame, the latch means on one frame cooperating with the catch means on the adjacent frame to secure said frames together.

6. Apparatus as defined in claim 5 and further including means on said latch means for abutment with means adjacent the exit of the furnace for disconnecting adjacent frames as they emerge from the furnace.

* * * * *